US005157210A

United States Patent [19]

Davis

[11] Patent Number: 5,157,210

[45] Date of Patent: Oct. 20, 1992

[54] SHOTGUN CARTRIDGE ADAPTER

[76] Inventor: Albert W. Davis, Rte. 1, Box 78, Riesel, Tex. 76682

[21] Appl. No.: 789,857

[22] Filed: Nov. 8, 1991

Related U.S. Application Data

[63] Continuation-in-part of Ser. No. 614,431, Nov. 16, 1990, abandoned.

[51] Int. Cl.[5] ..... F41A 21/10; F42B 8/00

[52] U.S. Cl. ..... 42/77; 102/446

[58] Field of Search ..... 42/77; 102/446

[56] References Cited

U.S. PATENT DOCUMENTS 783,561 2/1905 White ..... 42/77

1,191,618 7/1916 Saffold ..... 42/77

1,555,854 10/1925 Hill ..... 42/77

3,196,569 7/1965 Thomason ..... 42/77

3,384,989 5/1968 Thomas ..... 42/77

4,126,954 11/1978 Plummer ..... 42/77

*Primary Examiner*—Michael J. Carone

*Attorney, Agent, or Firm*—Crutsinger & Booth

[57] ABSTRACT

Adapter for safely firing a shotgun cartridge in a shotgun of a gauge larger than said cartridge comprising a tubular member having internal dimensions of a size to accommodate and hold snugly a cartridge of the gauge desired to be shot and external dimensions of a size to be accommodated in the shell chamber a shotgun in which it is desired to fire said cartridge.

14 Claims, 1 Drawing Sheet

SHOTGUN CARTRIDGE ADAPTER

CROSS REFERENCE TO RELATED APPLICATION

This application is a continuation-in-part of application Ser. No. 07/614,431 filed Nov. 16, 1990 entitled "SLIP SHOT SLEEVE FOR SHOTGUN SHELLS," now abandoned.

TECHNICAL FIELD

This invention relates to shotgun cartridge adapters and more particularly to an adapter to facilitate the safe use of shotgun cartridges designed for use in a gun of a specific bore size in guns of a larger bore size.

BACKGROUND OF THE INVENTION

Many shotgun shooters have found it desirable to be able to use several different sizes and types of cartridges in a single gun. To this end, some manufacturers have made available interchangeable barrels of different bores for particular guns. Such a system is not only bulky and expensive but inconvenient for quick conversion of the gun from one gauge to another.

It has also been suggested to provide full length barrel inserts bored to receive and fire smaller cartridges in the same gun. Aside from the cost of machining both the interior and exterior surfaces of such inserts additional means was needed for the extraction and ejection of fired shells from the gun. Such extraction and ejection was found especially difficult for pump action and autoloader type shotguns.

SUMMARY OF THE INVENTION

According to the present invention an adapter sheath or sleeve is provided to be applied to and carried with the shotgun cartridges to be used in the gun as opposed to a sleeve to be applied to and carried with the shotgun.

The adapter of the present invention is in the form of a cylindrical element having an external configuration generally of the shape and size (although shorter in length) of the shotgun cartridge for which the gun in which it is to be used is chambered. The internal configuration of the adapter is generally the same as a gun chamber sized to receive a shell of the selected gauge to be used.

Such shell adapters are inexpensive to manufacture since they are relatively small, can be made from a variety of inexpensive materials requiring minimal or no precision machining or which can be molded to form.

In addition, the adapters can be easily and quickly transferred from spent shells to live cartridges manually in the field. Further, a shooter can easily carry with him while engaged in hunting or other activities cartridges of various sizes appropriate for different types of game or other purposes that because they have already been installed in adapters can all be fired from the same gun.

It is an object of the present invention to provide an adapter to allow the safe firing in a shotgun of any cartridge of a smaller size than that for which the gun is chambered.

It is a further object to provide an adapter whereby appropriate cartridges of various sizes can be easily selected and fired from a single shotgun.

It is a still further object of the present invention to provide an adapter to allow cartridges of a smaller bore than the gun to be safely fired in repeating shotguns such as pump action and autoloader types.

It is an even further object of the present invention to provide an adapter whereby readily obtainable and/or less expensive shotgun cartridges can be safely used and fired in shotguns designed to use cartridges of obsolete, hard to find or overly expensive gauge sizes.

DESCRIPTION OF THE DRAWINGS

These and other objects and advantages of this invention will become apparent from the following detailed description when read with reference to the accompanying drawing wherein.

DETAILED DESCRIPTION OF THE PREFERRED EMBODIMENT OF THE INVENTION

Figure 2:
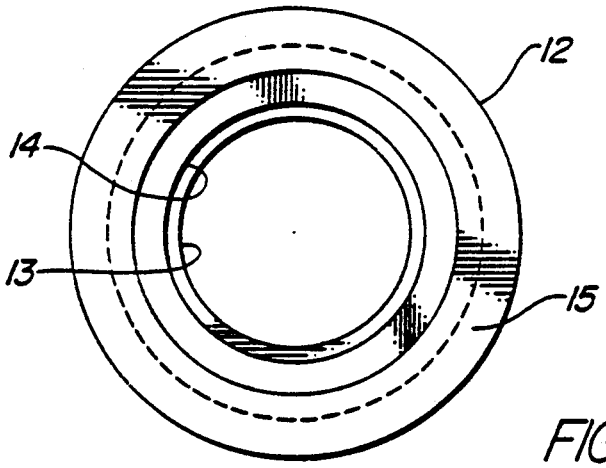
FIG. 2 is a rear end view of the adapter sleeve of FIG. 1.
Figure 1:
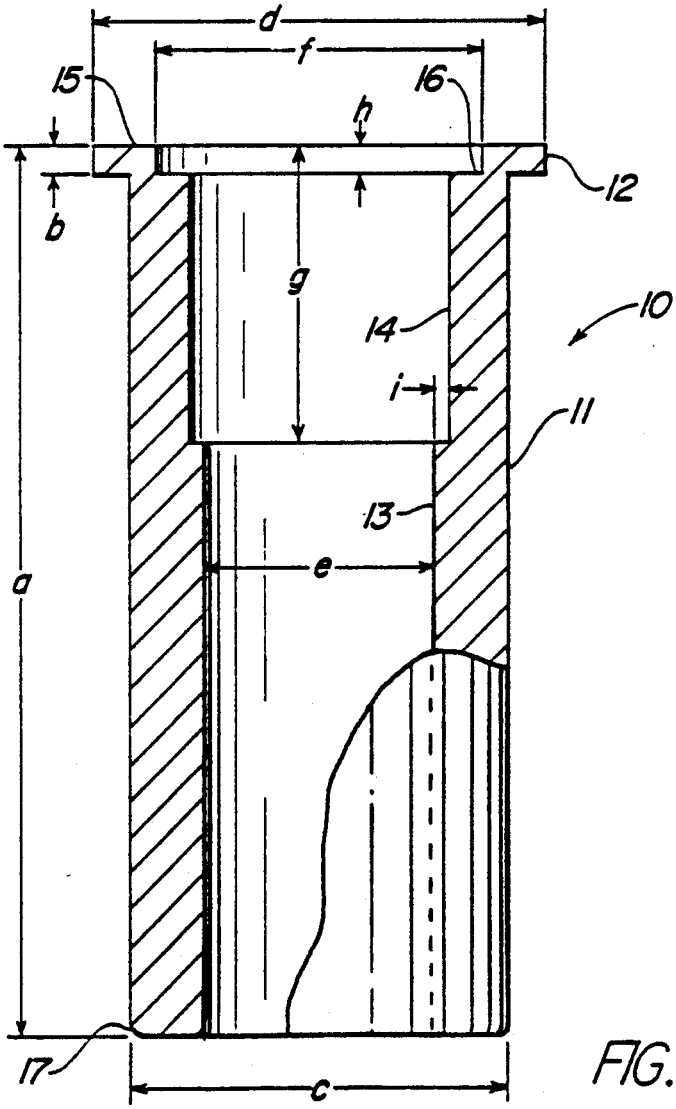
FIG. 1 is a side elevational view partly in section of the adapter sleeve of the present invention.

Referring now to the figures of the drawing, reference numeral 10 designates generally the adapter sleeve of the present invention, FIG. 1 being a side elevation view partly in section and FIG. 2 being a rear end view. Adapter 10 is of a generally cylindrical shape open at each end and having external dimensions substantially the same as a shotgun shell or cartridge of a gauge appropriate to be fired in the shotgun in which the sleeve is to be used. The internal dimensions of the sleeve 10 are appropriate to receive a shotgun cartridge of a gauge smaller than the bore of the shotgun in which it is desired to fire the cartridge.

More specifically, the sleeve 10 has a body portion 11 and a rim portion 12 of slightly larger diameter located at the rear end (top as shown in the drawing) of the sleeve. The external diameter of the body portion 11 is substantially the same as that of a shell cartridge of the gauge for which the gun to be used is designed. The rim or lip 12 is of a size substantially the same as the extractor rim on that same gauge cartridge.

Internally, the major portion of the body 11 has a bore defined by the wall 13 of a diameter to accommodate in a snug fit the external diameter of a cartridge of the gauge to be used and fired with the adapter sleeve. By "snug" fit is meant a fit tight enough that the adapter will retain a cartridge placed therein through all but the most severe handling and sudden movements such as, for example, being transported loose with other items or cartridges in a clothing pocket or ammunition pouch or carrier. Further a "snug" fit is not so tight that a live cartridge or spent shell cannot be safely and easily removed from the adapter manually without special tools.

At the rear end of the adapter 10 an internal wall 14 defines a region of a slightly larger internal bore that is for the purpose of accommodating expansion of the "brass" base of the cartridge used. The rear wall 15 of the adapter is provided with an inset 16 to accommodate the extraction rim of the cartridge used in the adapter.

The length of the adapter of the present invention should preferably be slightly less than the length, after firing, of the shotgun shell or cartridge with which it is to be used. Such a length provides easy means to start extraction of the fired shell from the adapter by pushing the front (open) end of a fired shell against a relatively hard surface while holding the adapter. Such action forces the fired shell backwards in the adapter a sufficient distance to expose the extractor rim of the fired shell. The shell can then be easily removed by hand by pulling the shell out by its rim. For this purpose the adapter should be at least about ⅛ inch shorter than the fired shell and preferably about ¼ inch shorter. If the adapter is to be used in a pump or auto loader gun it is desirable that its length be approximately the length of a live cartridge of the gauge for which the gun is designed.

In addition, it is advantageous to "round" the front edges of the adapter as shown at 17 if the adapter is to be used with pump or autoloader guns. Insertion of the adapter into the chamber of such guns is thus facilitated.

Thus, with the adapter of the present invention of an appropriate size any gauge of cartridge can be safely fired from any gun of a larger gauge. For example, 12, 16, 20 or 28 gauge or 0.410 bore cartridges can be safely fired from a ten gauge gun or 16, 20, or 28 gauge or 0.410 bore cartridges can be safely fired from a 12 gauge gun. Further, 28 gauge shells can be safely fired from a 20, 16, 12 or 10 gauge gun.

The following are examples of nominal dimensions as designated by the lower case letters on the drawing for the adapter of the present invention according to the gun gauge and shell gauge to be used with that gun.

EXAMPLE 1

Adapter dimensions in inches to fire a 20 gauge cartridge in a 12 gauge gun chambered for a three inch shell.

| | |
|---|---|
| a = | 2½ |
| b = | 1/16 |
| c = | 13/16 |
| d = | ⅞ |
| e = | 11/16 |
| f = | ¾ |
| g = | ¾ |
| h = | 1/16 |
| i = | 0.003 |

EXAMPLE 2

Adapter dimensions in inches to fire a 16 gauge cartridge in a 10 gauge gun chambered for a 2 ⅞ inch shell.

| For Auto Loader Gun | For Easy Extraction |
|---|---|
| a = 2⅜ | a = 2½ |
| b = 1/16 | b = 1/16 |
| c = ⅞ | c = ⅞ |
| d = 15/16 | d = 15/16 |
| | e = 11/16 |
| | f = ¾ |
| | g = ¾ |
| | h = 1/16 |
| | i = 0.003 |

EXAMPLE 3

Adapter dimensions in inches to fire a 0.410 cartridge in a 20 gauge gun chambered for 2 ¾ inch shell.

| | |
|---|---|
| a = | 2½ |
| b = | 1/16 |
| c = | 11/16 |
| d - | ¾ |
| e = | 15/32 |
| f = | 17/32 |
| g = | ½ |

-continued

| | |
|---|---|
| h = | 1/16 |
| i = | 0.003 |

The adapter of the present invention may be made of any suitable metal, such as brass, steel, stainless steel or other metal or of a suitable plastic such as the plastics currently used for commercial shotgun cartridges.

There still in use or available for use many shotguns of the standard 10, 12, 16, 20, 28 gauges and 0.410 bore. However, for various reasons ammunition manufacturers have severely reduced production of 10, 16 and 28 gauge cartridges which have become unpopular and expensive. The adapter of the present invention will allow more extensive use of shotguns of these obsolete gauges by providing for the use therein of cartridges of the more readily available gauges.

Although the adapter of the present invention allows safe use of any gauge shotgun cartridge in any larger gauge shotgun it has been found that best shooting results are obtained when cartridges of a particular gauge are used with an adapter in a gun of the next largest gauge. Thus, preferred usage will adapt 12 gauge cartridges to use in a 10 gauge gun, 20 gauge cartridges to use in a 16 gauge gun and 0.410 cartridges in a 28 gauge gun.

There has been described an adapter for the safe use in a shotgun of cartridges of any size smaller than that for which the shotgun is designed. The above description of this invention is intended to be illustrative only and not in any way to restrict the invention which is to be limited only as set forth in the following claims.

What is claimed is:

1. An adapter for firing a shotgun cartridge in a shotgun of a bore larger than said cartridge comprising: a tubular member open at each end having a body portion of an external diameter essentially the same as a cartridge to fit the shell chamber of said shotgun in which said adapter is to be used, an overall length shorter than the length of a fired shotgun cartridge of the gauge for use with said adapter and a relatively thin external rim at the rear thereof of a diameter slightly larger than the diameter of said body portions; said adapter having a central bore longitudinally therethrough of a diameter slightly smaller than the diameter of a shotgun shell chamber of the gauge desired to be used with said adapter and further having an inset at the rear thereof of a diameter and depth to receive the extractor rim of a shotgun cartridge of said desired gauge and hold said cartridge snugly and with its rear wall essentially flush with the rear wall of said adapter.

2. The adapter of claim 1 made of metal.

3. The adapter of claim 1 made of plastic.

4. The adapter of claim 2 having a region of slightly enlarged internal diameter extending a short distance forward from said inset.

5. The adapter of claim 4 wherein said short distance is about ¾ of an inch.

6. The adapter of claim 1 wherein the external front edge thereof is rounded.

7. The adapter of claim 2 wherein the external front edge thereof is rounded.

8. An adapter for firing a shotgun cartridge in a shotgun of a bore larger than said cartridge comprising: a tubular member open at each end having a body portion of an external diameter just smaller than the shell chamber of the shotgun in which it is to be used, of an overall length of between $\frac{1}{8}$ and $\frac{1}{4}$ inch shorter than the length of a fired shotgun cartridge of the gauge to be used with said adapter and an external rim at the rear thereof of a diameter about 1/16 inch larger than said external diameter and about 1/16 inch long; said adapter having a hole therethrough of a diameter slightly larger than the external diameter of a shotgun shell of the gauge to be used with said adapter and further having an inset at the rear thereof of a diameter about 1/16 inch larger than said bore diameter and about 1/16 inch deep.

9. The adapter of claim 8 made of metal.

10. The adapter of claim 8 made of plastic.

11. The adapter of claim 9 wherein said metal comprises steel.

12. The adapter of claim 9 wherein said metal comprises brass.

13. The adapter of claim 11 wherein the external front edge is rounded.

14. The adapter of claim 12 wherein the external front edge is rounded.

* * * * *